US010974864B2

(12) United States Patent
Sollie et al.

(10) Patent No.: US 10,974,864 B2
(45) **Date of Patent: *Apr. 13, 2021**

(54) REINFORCED COLLAPSIBLE BOX

(71) Applicant: Pratt Corrugated Holdings, Inc., Conyers, GA (US)

(72) Inventors: Greg Sollie, Sharpsburg, GA (US); Jamie Waltermire, Peachtree City, GA (US)

(73) Assignee: Pratt Corrugated Holdings, Inc., Conyers, GA (US)

( * ) Notice: Subject to any disclaimer, the term of this patent is extended or adjusted under 35 U.S.C. 154(b) by 11 days.

This patent is subject to a terminal disclaimer.

(21) Appl. No.: 16/554,699

(22) Filed: Aug. 29, 2019

(65) Prior Publication Data

US 2019/0382154 A1 Dec. 19, 2019

Related U.S. Application Data

(63) Continuation of application No. 15/699,534, filed on Sep. 8, 2017, now Pat. No. 10,435,194.

(51) Int. Cl.

| | |
|---|---|
| ***B65D 5/36*** | (2006.01) |
| ***B65D 5/42*** | (2006.01) |
| ***B65D 5/66*** | (2006.01) |

(52) U.S. Cl.

CPC ..... *B65D 5/3628* (2013.01); *B65D 5/36* (2013.01); *B65D 5/42* (2013.01); *B65D 5/4266* (2013.01); *B65D 5/66* (2013.01); *B65D 5/6605* (2013.01)

(58) Field of Classification Search

CPC .. B65D 5/6605; B65D 5/6608; B65D 5/3628; B65D 5/36; B65D 5/103; B65D 5/106; B65D 5/445; B65D 5/6629; B65D 5/6632; B65D 5/6635; B65D 5/6638; B65D 5/323

USPC ..... 229/199, 919, 915, 920

See application file for complete search history.

(56) References Cited

U.S. PATENT DOCUMENTS

| | | | | |
|---|---|---|---|---|
| 284,179 | A | 9/1883 | Buckingham | |
| 902,213 | A | 10/1908 | Davidson | |
| 1,514,367 | A | 11/1924 | Bliss | |
| 1,627,311 | A | 5/1927 | Bliss | |
| 1,697,709 | A * | 1/1929 | Bliss | B65D 5/323 229/122.26 |

(Continued)

FOREIGN PATENT DOCUMENTS

| | | |
|---|---|---|
| GB | 559084 | 2/1944 |

OTHER PUBLICATIONS

Sollie, Greg; Non-Final Office Action for U.S. Appl. No. 15/699,534, filed Sep. 8, 2017, dated May 1, 2019, 11 pgs.

(Continued)

*Primary Examiner* — Justin M Larson

(74) *Attorney, Agent, or Firm* — Taylor English Duma LLP

(57) ABSTRACT

A reinforced box includes a body board including a first material, the body board including a bottom panel defining a first bottom side and a second bottom side, the first bottom side positioned opposite from the second bottom side; a first side panel hingedly attached to the first bottom side of the bottom panel; and a second side panel hingedly attached to the second bottom side of the bottom panel; and an end panel including a second material, the second material being different from the first material, the end panel attached to the first side panel and the second side panel.

18 Claims, 11 Drawing Sheets

(56) References Cited

U.S. PATENT DOCUMENTS

| | | | | |
|---|---|---|---|---|
| 1,779,403 | A | 10/1930 | Greve | |
| 2,727,675 | A | 12/1955 | Mairs et al. | |
| 3,058,585 | A | 10/1962 | Budd | |
| 3,197,108 | A * | 7/1965 | Northway | B65D 5/446 229/122.22 |
| 3,434,648 | A * | 3/1969 | Du Barry, Jr. | B65D 5/323 229/122.26 |
| 3,709,425 | A * | 1/1973 | Stapp | B65D 5/446 229/122.22 |
| 3,831,834 | A * | 8/1974 | Elward | B65D 5/322 229/122.23 |
| 5,062,527 | A | 11/1991 | Westerman | |
| 5,887,782 | A | 3/1999 | Mueller | |
| 6,135,347 | A | 10/2000 | Mueller | |
| 6,168,074 | B1 | 1/2001 | Petriekis et al. | |
| 6,763,309 | B2 | 7/2004 | Kieken et al. | |
| 6,837,420 | B2 | 1/2005 | Westerman et al. | |
| 7,841,512 | B2 | 11/2010 | Westerman et al. | |
| D710,691 | S | 8/2014 | Genender | |
| D710,692 | S | 8/2014 | Genender | |
| 8,875,983 | B2 | 11/2014 | Lenhard et al. | |
| D720,989 | S | 1/2015 | Genender et al. | |
| 9,169,037 | B2 | 10/2015 | Pinkstone | |
| 9,260,216 | B1 | 2/2016 | Costanzo, Jr. | |
| 10,435,194 | B2 | 10/2019 | Sollie et al. | |
| 2004/0164132 | A1 | 8/2004 | Kuester | |
| 2006/0186186 | A1 | 8/2006 | Kuhn et al. | |
| 2012/0317931 | A1 | 12/2012 | Dunivan et al. | |
| 2019/0077539 | A1 | 3/2019 | Sollie et al. | |

OTHER PUBLICATIONS

Sollie, Greg; Notice of Allowance for U.S. Appl. No. 15/699,534, filed Sep. 8, 2017, dated Jun. 5, 2019, 5 pgs.

President Container; Article entitled: "President Container—Bliss Box Kwik-Pak"; located at <http://presidentcontainergroup.com/president/products/>, publicly available prior to Sep. 8, 2017, 2 pgs.

* cited by examiner

REINFORCED COLLAPSIBLE BOX

REFERENCE TO RELATED APPLICATIONS

This application is a continuation of U.S. application Ser. No. 15/699,534, filed Sep. 8, 2017, which is hereby specifically incorporated by reference herein in its entirety.

TECHNICAL FIELD

This disclosure relates to packaging. More specifically, this disclosure relates to a reinforced box.

BACKGROUND

Many boxes are often formed from a single sheet of material, such as a box blank. The box blank can often be a rigid board material, such as corrugated cardboard. The structural strength can depend upon the strength of the material used. For example, using a stronger material for the box can increase a stacking strength of the box which is the amount of downward force that can be exerted on the box before the box fails. However, not all portions of the box contribute equally to the stacking strength of the box, and some panels may not require heavier material to maintain the stacking strength of the box. For example, a bottom panel of the box has little effect on the stacking strength of the box; however, side panels of the box demonstrate a large effect on the stacking strength of the box. Because many box designs are formed from a single sheet of material, the bottom panel is often also comprised of heavier material than necessary to provide the desired stacking strength of the box leading to increased material costs.

SUMMARY

It is to be understood that this summary is not an extensive overview of the disclosure. This summary is exemplary and not restrictive, and it is intended to neither identify key or critical elements of the disclosure nor delineate the scope thereof. The sole purpose of this summary is to explain and exemplify certain concepts of the disclosure as an introduction to the following complete and extensive detailed description.

Disclosed is a reinforced box comprising a body board comprising a first material, the body board comprising a bottom panel defining a first bottom side and a second bottom side, the first bottom side positioned opposite from the second bottom side; a first side panel hingedly attached to the first bottom side of the bottom panel; and a second side panel hingedly attached to the second bottom side of the bottom panel; and an end panel comprising a second material, the second material being different from the first material, the end panel attached to the first side panel and the second side panel.

Also disclosed is a method of assembling a reinforced box, the method comprising folding a first side panel about a first side hinge relative to a bottom panel; folding a second side panel about a second side hinge relative to the bottom panel, the first side panel, the second side panel, and the bottom panel comprised by a body board of the reinforced box, the body board comprising a first material; attaching a first end panel to the first side panel and the second side panel, the first end panel comprising a second material, the second material being different from the first material; and attaching a second end panel to the first side panel and the second side panel, the second end panel comprising the second material.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims. The features and advantages of such implementations may be realized and obtained by means of the systems, methods, features particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

The features and components of the following figures are illustrated to emphasize the general principles of the present disclosure. The drawings are not necessarily drawn to scale. Corresponding features and components throughout the figures may be designated by matching reference characters for the sake of consistency and clarity.

DETAILED DESCRIPTION

Figure 1:
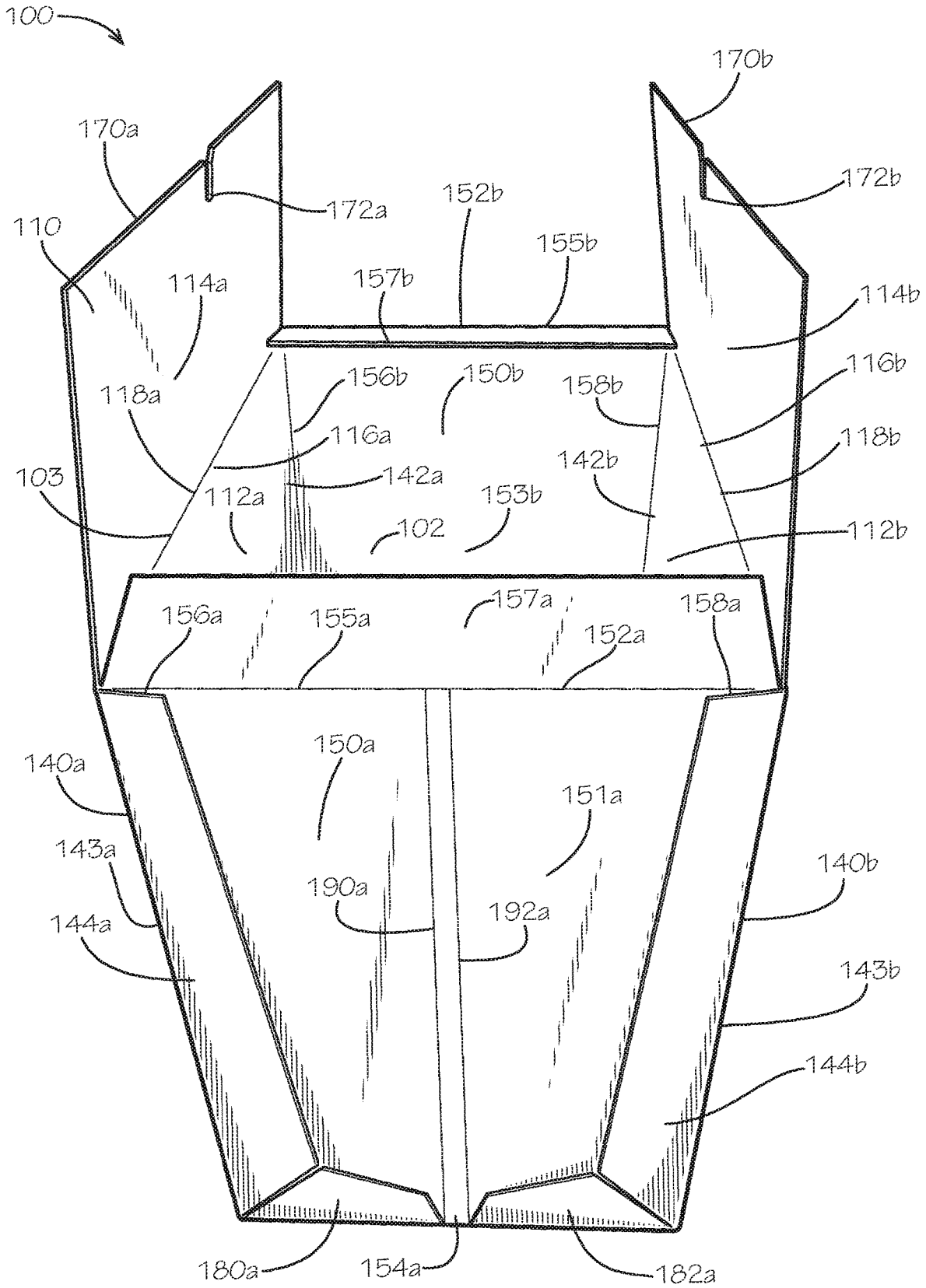
FIG. 1 is a top perspective view of a reinforced box in an open configuration in accordance with one aspect of the present disclosure.

The present disclosure can be understood more readily by reference to the following detailed description, examples, drawings, and claims, and the previous and following description. However, before the present devices, systems, and/or methods are disclosed and described, it is to be understood that this disclosure is not limited to the specific devices, systems, and/or methods disclosed unless otherwise specified, and, as such, can, of course, vary. It is also to be understood that the terminology used herein is for the purpose of describing particular aspects only and is not intended to be limiting.

The following description is provided as an enabling teaching of the present devices, systems, and/or methods in its best, currently known aspect. To this end, those skilled in the relevant art will recognize and appreciate that many changes can be made to the various aspects of the present devices, systems, and/or methods described herein, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise. Thus, for example, reference to "an element" can include two or more such elements unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

For purposes of the current disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes and between different models, the tolerance for a particular measurement of a particular component can fall within a range of tolerances.

As used herein, the terms "optional" or "optionally" mean that the subsequently described event or circumstance can or cannot occur, and that the description includes instances where said event or circumstance occurs and instances where it does not.

The word "or" as used herein means any one member of a particular list and also includes any combination of members of that list. Further, one should note that conditional language, such as, among others, "can," "could," "might," or "may," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily include logic for deciding, with or without user input or prompting, whether these features, elements and/or steps are included or are to be performed in any particular aspect.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific aspect or combination of aspects of the disclosed methods.

Disclosed is a reinforced box and associated methods, systems, devices, and various apparatus. The reinforced box comprises a body board, a first end panel, and a second end panel. It would be understood by one of skill in the art that the disclosed reinforced box is described in but a few exemplary embodiments among many. No particular terminology or description should be considered limiting on the disclosure or the scope of any claims issuing therefrom.

FIG. 1 is a top perspective view of a reinforced box 100 in an open configuration in accordance with one aspect of the present disclosure. The reinforced box 100 can comprise a body board 110, a first end panel 150*a*, and a second end panel 150*b*. The first end panel 150*a* and the second end panel 150*b* can be arranged opposite from one another as a pair of opposing end panels 150*a,b*. The body board 110 can comprise a first side panel 112*a* and a second side panel 112*b*. The first side panel 112*a* and the second side panel 112*b* can be arranged opposite from one another as a pair of opposing side panels 112*a,b*. A box cavity 102 can be defined within the reinforced box 100 by the side panels 112*a,b* and the end panels 150*a,b*.

Each of the side panels 112*a,b* can define a first side 140*a,b* and a second side 142*a,b*, respectively, and the first sides 140*a,b* can be disposed opposite from the second sides 142*a,b*. The first sides 140*a,b* can be positioned by the first end panel 150*a*, and the second sides 142*a,b* can be positioned by the second end panel 150*b*. Each of the side panels 112*a,b* can define a top end 116*a,b*, respectively, extending between the sides 140*a,b*,142*a,b*.

Each of the end panels 150*a,b* can define a top end 152*a,b*, respectively, and in the present aspect, the top ends 152*a,b* of the end panels 150*a,b* can be substantially flush with the top ends 116*a,b* of the respective side panels 112*a,b*. The top ends 116*a,b*,152*a,b* can define a box opening 103 of the box cavity 102. The box opening 103 can be uncovered and the box cavity 102 can be exposed in the open configuration. Each of the end panels 150*a,b* can define a bottom end 154*a,b* (bottom end 154*b* shown in FIG. 2). Each of the end panels 150*a,b* can define a first side 156*a,b* positioned adjacent to the first side panel 112*a* and a second side 158*a,b* positioned adjacent to the second side panel 112*b*. Each end panel 150*a,b* can respectively define an outer surface 151*a,b* (outer surface 151*b* shown in FIG. 2) and an inner surface 153*a,b* (inner surface 153*a* shown in FIG. 8). The inner surfaces 153*a,b* can face inwards towards the box cavity 102, and the outer surfaces 151*a,b* can face outwards and away from the box cavity 102.

A first side flap 144*a,b* of the respective side panel 112*a,b* can each be hingedly attached to the respective first side 140*a,b* by a first side flap hinge 143*a,b*, respectively. The first side flaps 144*a,b* can be folded at the first side flap hinges 143*a,b* to cover portions of the outer surface 151*a* proximate to the respective sides 156*a*,158*a* of the first end panel 150*a*. The first side flaps 144*a,b* can be attached to the outer surface 151*a* of the first end panel 150*a* to secure the first end panel 150*a* to the side panels 112*a,b*. In the present aspect, the first side flaps 144*a,b* can be bonded to the first end panel 150*a* with an adhesive; however in other aspects, the first side flaps 144*a,b* can be attached to the first end panel 150*a* through another method, such as stapling, stitching, or any other suitable method.

Additionally, a first end flap 180*a* and a second end flap 182*a* can be folded over and attached to the outer surface 151*a* of the first end panel 150*a* at the bottom end 154*a* to further secure the first end panel 150*a* to the body board 110. In the present aspect, the end flaps 180*a*,182*a* can be bonded to the first end panel 150*a* with an adhesive; however in other aspects, the end flaps 180*a*,182*a* can be attached to the first end panel 150*a* through another method, such as stapling, stitching, or any other suitable method.

In the present aspect, the first end panel 150*a* can define a first end fold line 190*a* and a second end fold line 192*a* which can extend from the top end 152*a* to the bottom end 154*a* of the first end panel 150*a*. The first end fold line 190*a* can be spaced apart from and substantially parallel to the second end fold line 192*a* so that a portion of the first end panel 140*a* extends between the first end fold line 190*a* and the second end fold line 192*a*. The first end flap 180*a* can be positioned between the first side panel 112*a* and the first end fold line 190*a*, and the second end flap 182*a* can be positioned between the second side panel 112*b* and the second end fold line 192*a*.

A first top flap 114*a* can be hingedly attached to the top end 116*a* of the first side panel 112*a* by a first top flap hinge 118*a*. A second top flap 114*b* can be hingedly attached to the top end 116*b* of the second side panel 112*b* by a second top flap hinge 118*b*. Each top flap 114*a,b* can define a top flap end 170*a,b*, respectively, which can be disposed opposite from the respective top flap hinge 118*a,b*. Each of the top flap ends 170*a,b* can define a respective top notch 172*a,b*.

A first top end flap 157*a* can be hingedly attached to the top end 152*a* of the first end panel 150*a* by a first top flap hinge 155*a*. A second top end flap 157*b* can be hingedly attached to the top end 152*b* of the second end panel 150*b* by a second top flap hinge 155*b*. In the present aspect, the top end flaps 157*a,b* can be sized smaller than the top flaps 114*a,b*; however in other aspects, the top end flaps 157*a,b* can be equal to or larger in size than the top flaps 114*a,b*. As shown, the end fold lines 190*a*,192*a* can also extend across the first top end flap 157*a*.

Figure 12:
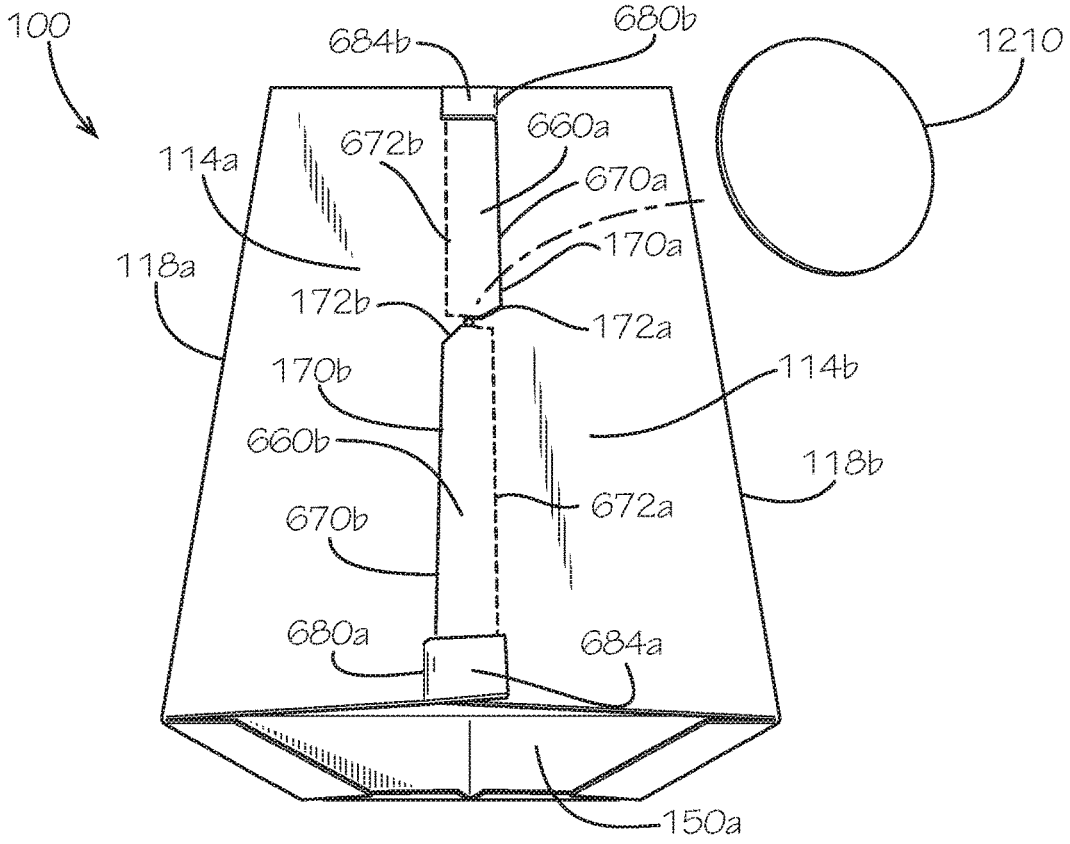
FIG. 12 is a perspective top view of the reinforced box of FIG. 1 in the closed configuration and further comprising an adhesive seal.

To enclose the box cavity 102, the top end flaps 157*a,b* can be folded inwards to partially cover the box opening 103, and then the top flaps 114*a,b* can be folded inwards to fully enclose and cover the box opening 103. A first top notch 172*a* of the top notches 172*a,b* can be configured to engage and interlock with a second top notch 172*b* of the top notches 172*a,b*. With the top notches 172*a,b* interlocked, the top flaps 114*a,b* can be secured together in a closed configuration, as shown in FIG. 12.

Figure 2:
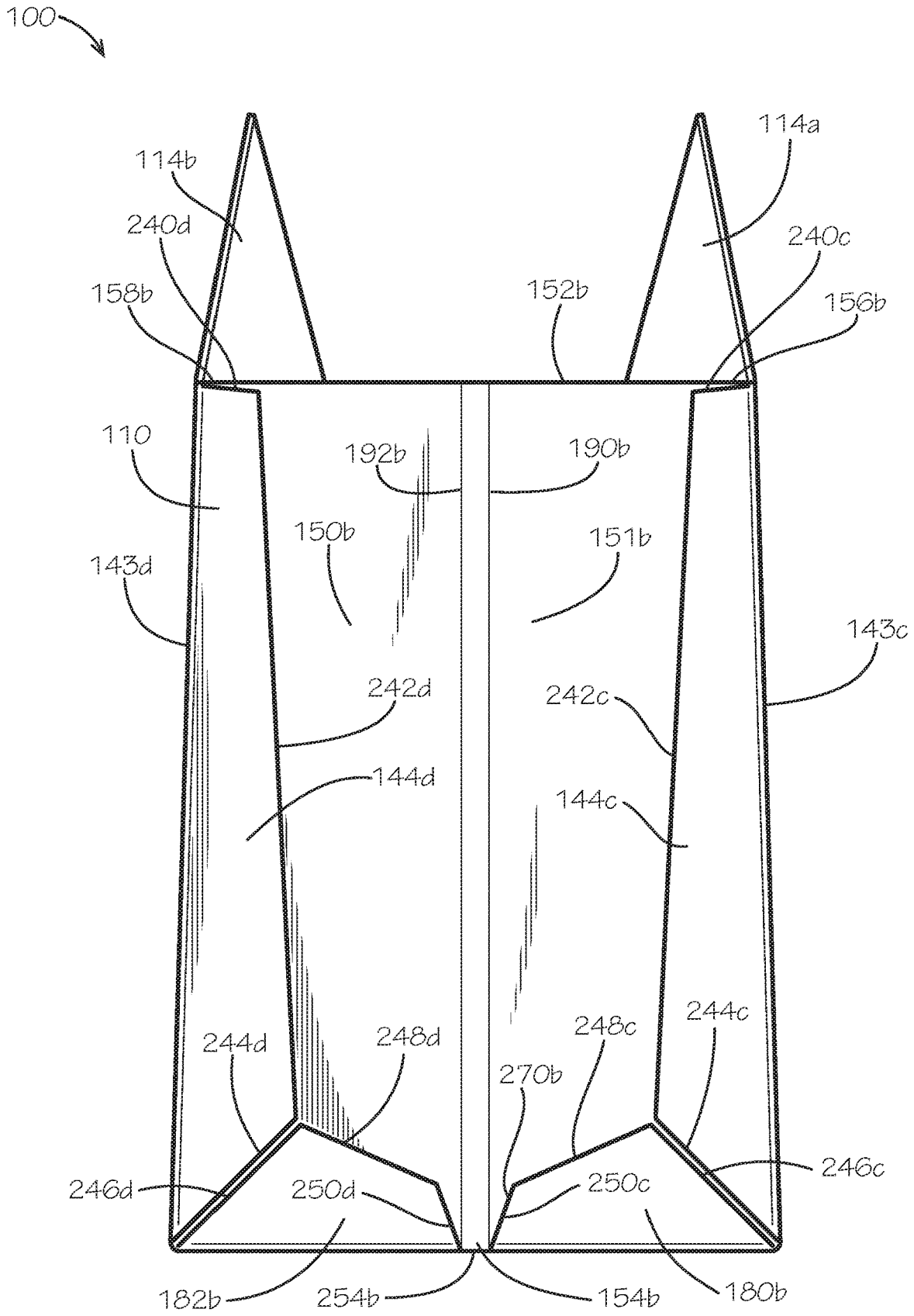
FIG. 2 is a perspective side view of the reinforced box of FIG. 1 facing a second end panel of the reinforced box.

FIG. 2 is a side view of the reinforced box 100 facing the second end panel 150*b*. Similar to the first end panel 150*a* of FIG. 1, the second end panel 150*b* can be attached to the body board 110 by attaching a second side flap 144*c,d* of the respective side panels 112*a,b* (shown in FIG. 1) to the outer surface 151*b* of the second end panel 150*b*. The second side flaps 144*c,d* can be hingedly attached to the respective side panels 112*a,b* (shown in FIG. 1) by second side flap hinges 143*c,d*. A first end flap 180*b* and a second end flap 182*b* can also be attached to the outer surface 151*b* of the second end panel 150*b*. The first end flap 180*b* can be disposed between the first side 156*b* of the second end panel 150*b* and a first end fold line 190*b*, and the second end flap 182*b* can be disposed between the second side 158*b* of the second end panel 150*b* and a second end fold line 192*b*.

Figure 3:
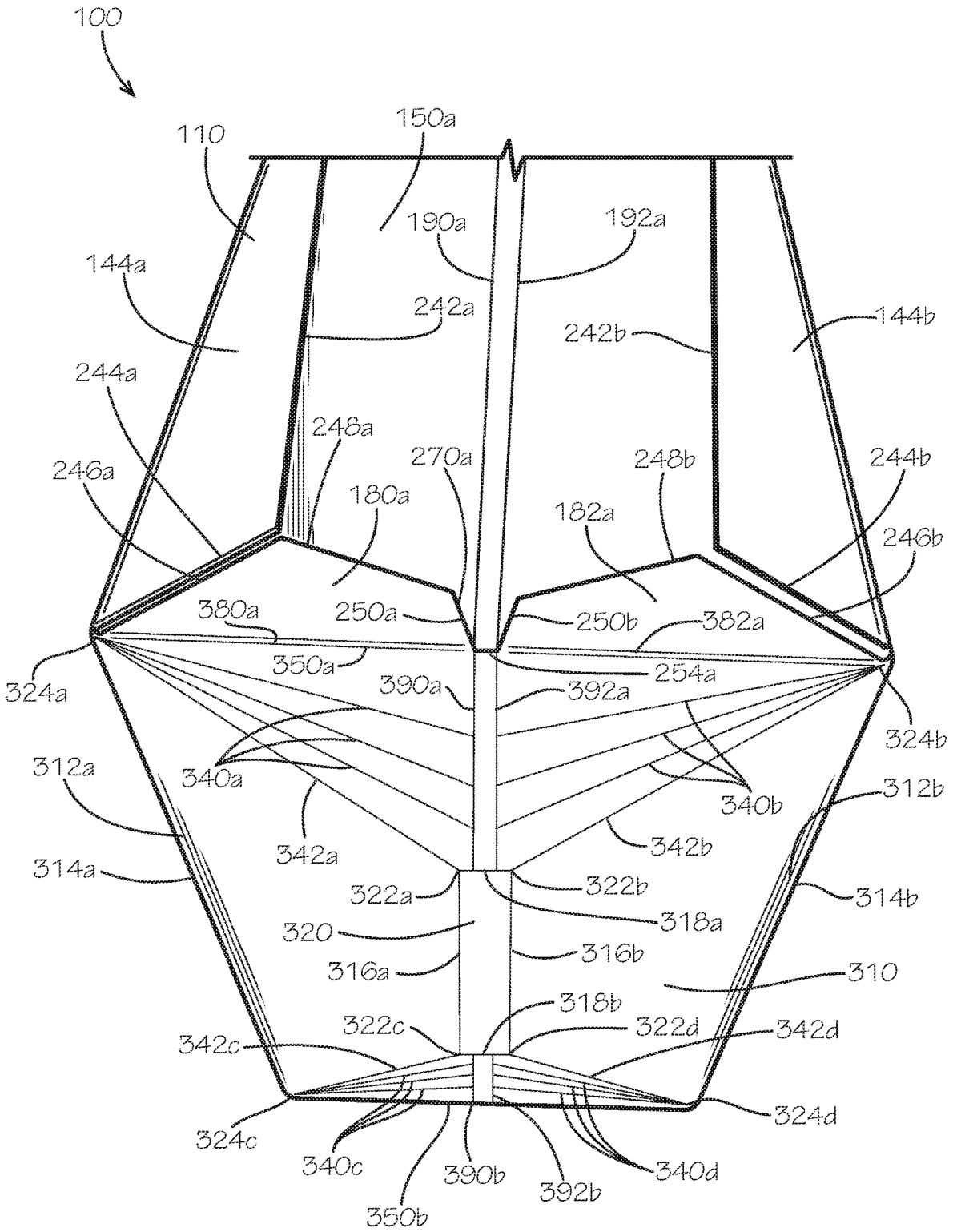
FIG. 3 is a bottom perspective view of the reinforced box of FIG. 1 facing a first end panel and a bottom panel of the reinforced box.
Figure 6:
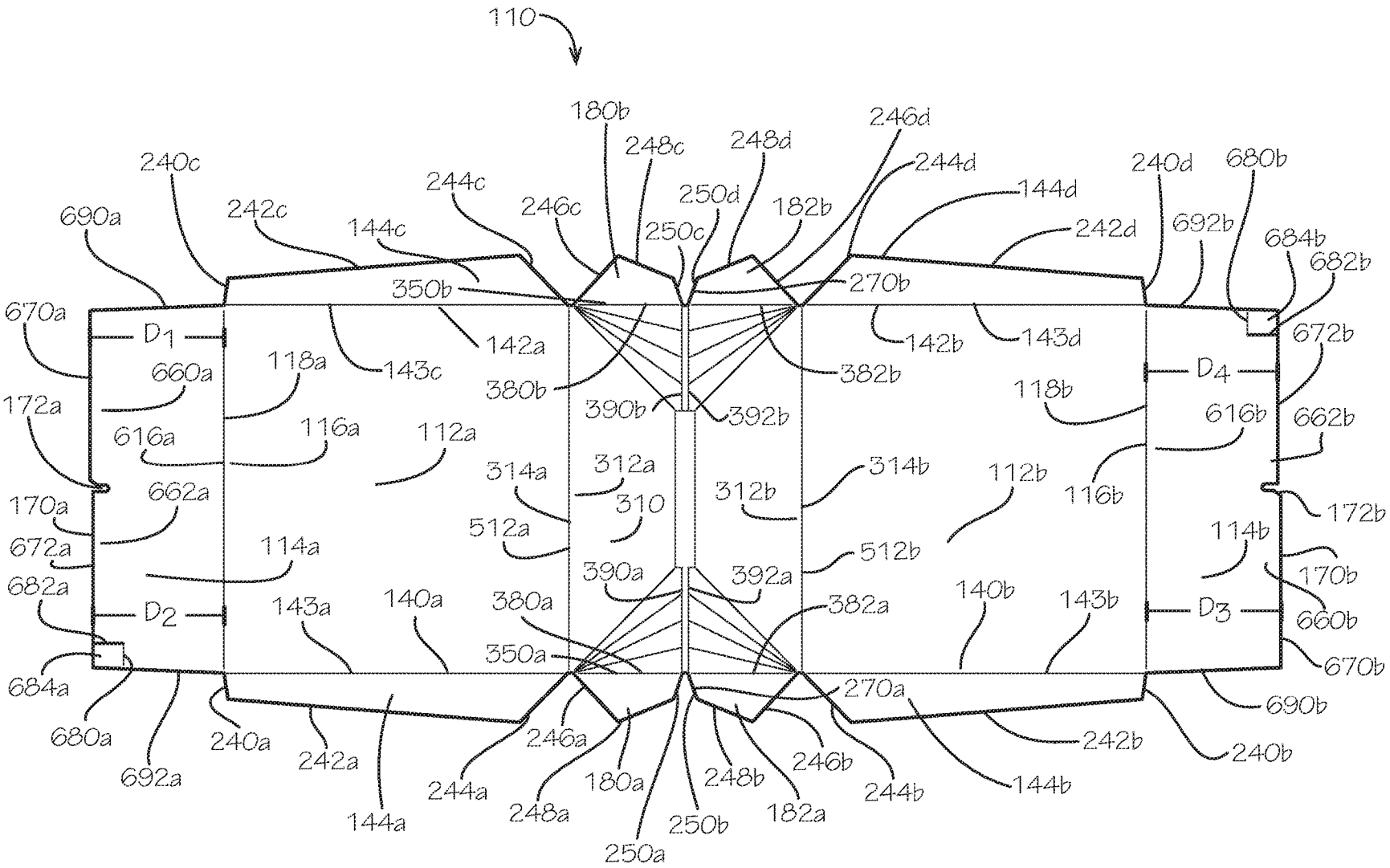
FIG. 6 is a top view of a body board of the reinforced box of FIG. 1.

Each of the side flaps 144*a-d* can respectively define a top edge 240*a-d*, a major edge 242*a-d*, and a minor edge 244*a-d*, as shown in FIG. 6. Each of the end flaps 180*a,b*,182*a,b* can respectively define outer edges 246*a-d*, middle edges 248*a-d*, and inner edges 250*a-d*, as shown in FIG. 6. In the present aspect, the minor edges 244*a-d* can align with the adjacent outer edges 246*a-d*, as shown by the minor edges 244*c,d* and outer edges 246*c,d*. In the present aspect, an end flap notch 270*b* can be defined between adjacent inner edges 250*c,d*, and an end flap notch 270*a* can be defined between adjacent inner edges 250*a,b*, as shown in FIG. 3. In the present aspect, the end fold lines 190*b*,192*b* can intersect the inner edges 250*c,d*, and spacing between the end fold lines 190*b*,192*b* can define a flat tip 254*b* of the end flap notch 270*b*. In other aspects, adjacent inner edges 250*a-d* can intersect to define V-shaped notches between the adjacent end flaps 180*a,b*,182*a,b*.

FIG. 3 is a bottom perspective view of the reinforced box 100 facing the first end panel 150*a* and a bottom panel 310 of the body board 110. The bottom panel 310 can further define and enclose the box cavity 103 (box cavity 103 shown in FIG. 1). The bottom panel 310 can define a first bottom side 312*a* and a second bottom side 312*b* which can be disposed opposite from the first bottom side 312*a*. The first side panel 112*a* (first side panel 112*a* shown in FIG. 1) can be hingedly attached to the first bottom side 312*a* by a first side hinge 314*a*, and the second side panel 112*b* (second side panel 112*b* shown in FIG. 1) can be hingedly attached to the second bottom side 312*b* by a second side hinge 314*b*.

The bottom panel 310 can define a first bottom end 350*a* and a second bottom end 350*b*, and the second bottom end 150*b* can be disposed opposite from the first bottom end 350*a*. The first bottom end 350*a* can be positioned adjacent to the first end panel 150*a*, and the second bottom end 350*b* can be positioned adjacent to the second end panel 150*b* (shown in FIG. 2). The first end flap 180*a* and the second end flap 182*a* can be attached to the first bottom end 350*a* by a first end flap hinge 380*a* and a second end flap hinge 382*a*, respectively. The flat tip 254*a* of the end flap notch 270*a* can be defined by a portion of the first bottom end 350*a* between the first end flap hinge 380*a* and the second end flap hinge 382*b*.

Figure 5:
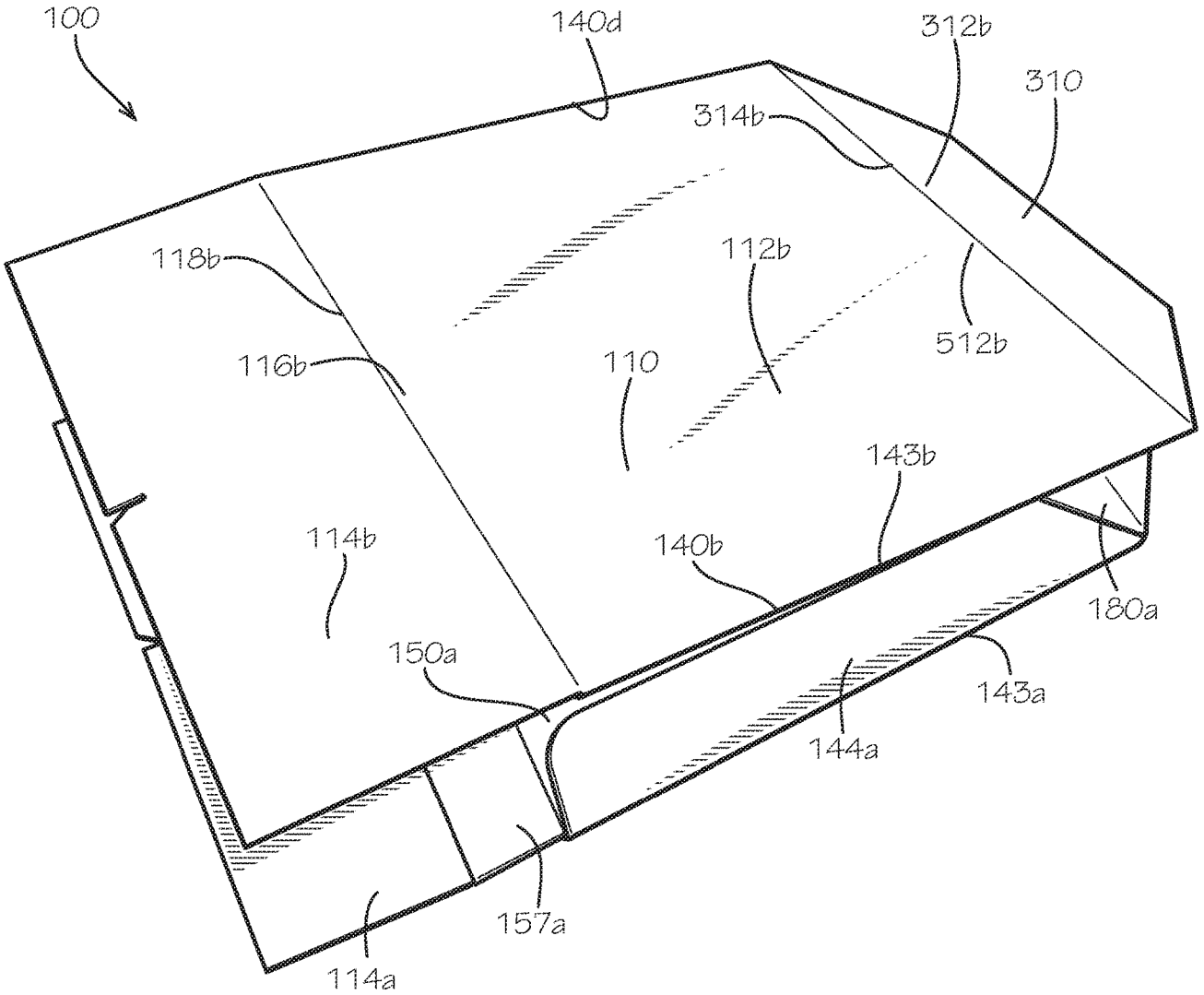
FIG. 5 is a perspective view of the reinforced box of FIG. 1 in a collapsed configuration.

The end flap notches 270*a,b* and the end fold lines 190*a,b*,192*a,b* can cooperate to transition the box 100 from the open configuration shown in the present aspect to a collapsed configuration shown in FIG. 5. The respective end panels 150*a,b* can fold substantially in half along the respective end fold lines 190*a,b*,192*a,b*, and the end flap notches 270*a,b* can provide clearance between adjacent end flaps 180*a,b*,182*a,b* for collapsing the end panels 150*a,b*.

A first bottom corner 324*a* of the bottom panel 310 can be defined at an intersection of the first bottom end 350*a* and the first bottom side 312*a*. A second bottom corner 324*b* of the bottom panel 310 can be defined at an intersection of the first bottom end 350*a* and the second bottom side 312*b*. A third bottom corner 324*c* can be defined at an intersection of the second bottom end 350*b* and the first bottom side 312*a*. A fourth bottom corner 324*d* can be defined at an intersection of the second bottom end 350*b* and the second bottom side 312*b*.

In the present aspect, the bottom panel 310 can define a plurality of fold lines configured to collapse the bottom panel 310 when reconfiguring the reinforced box 100 from the open configuration to the collapsed configuration. The fold lines of the bottom panel 310 can cooperate to collapse the bottom panel 310 to a truncated rectangular pyramidal shape, as shown in FIG. 5. The bottom panel 310 can define a center subpanel 320 disposed at a center of the bottom panel 310. The center subpanel 320 can define a first end fold line 318*a*, a second end fold line 318*b*, a first side fold line 316*a*, and a second side fold line 316*b*. The end fold lines 318*a,b* can be substantially parallel to the bottom ends 350*a,b*, and the side fold lines 316*a,b* can be substantially parallel to the bottom sides 312*a,b*.

A first fold line corner 322*a* can be defined at an intersection of the first end fold line 318*a* and the first side fold line 316*a*. A second fold line corner 322*b* can be defined at an intersection of the first end fold line 318*a* and the second side fold line 316*b*. A third fold line corner 322*c* can be defined at an intersection of the second end fold line 318*b* and the first side fold line 316*a*. A fourth fold line corner 322*d* can be defined at an intersection of the second end fold line 318*b* and the second side fold line 316*b*.

A first corner fold line 342*a* can extend between the first fold line corner 322*a* and the first bottom corner 324*a*. A second corner fold line 342*b* can extend between the second fold line corner 322*b* and the second bottom corner 324*b*. A third corner fold line 342*c* can extend between the third fold line corner 322*c* and the third bottom corner 324*c*. A fourth corner fold line 342*d* can extend between the fourth fold line corner 322*d* and the fourth bottom corner 324*d*.

The bottom panel 310 can define first end fold lines 390*a,b* and second end fold lines 392*a,b* which can respectively align with the first end fold lines 190*a,b* and the second end fold lines 392*a,b* of the end panels 150*a,b*. The end fold lines 390*a*,392*a* can extend between the first bottom end 350*a* and the first end fold line 318*a*, and the end fold lines 390*b*,392*b* can extend between the second bottom end 350*b* and the second end fold line 318*b*.

A first plurality of fold lines 340*a* can extend from the first bottom corner 324*a* to the first end fold line 390*a*. The first plurality of fold lines 340*a* can be defined between the first corner fold line 342*a* and the first bottom end 350*a*. A second plurality of fold lines 340*b* can extend from the second bottom corner 324*b* to the second end fold line 392*a*. The second plurality of fold lines 340*b* can be defined between the second corner fold line 342*b* and the first bottom end 350*a*. A third plurality of fold lines 340*c* can extend from the third bottom corner 324*c* to the first end fold line 390*b*. The third plurality of fold lines 340*c* can be defined between the third corner fold line 342*c* and the second bottom end 350*b*. A fourth plurality of fold lines 340*d* can extend from the fourth bottom corner 324*d* to the second end fold line 392*b*. The fourth plurality of fold lines 340*d* can be defined between the fourth corner fold line 342*d* and the second bottom end 350*b*.

Figure 4:
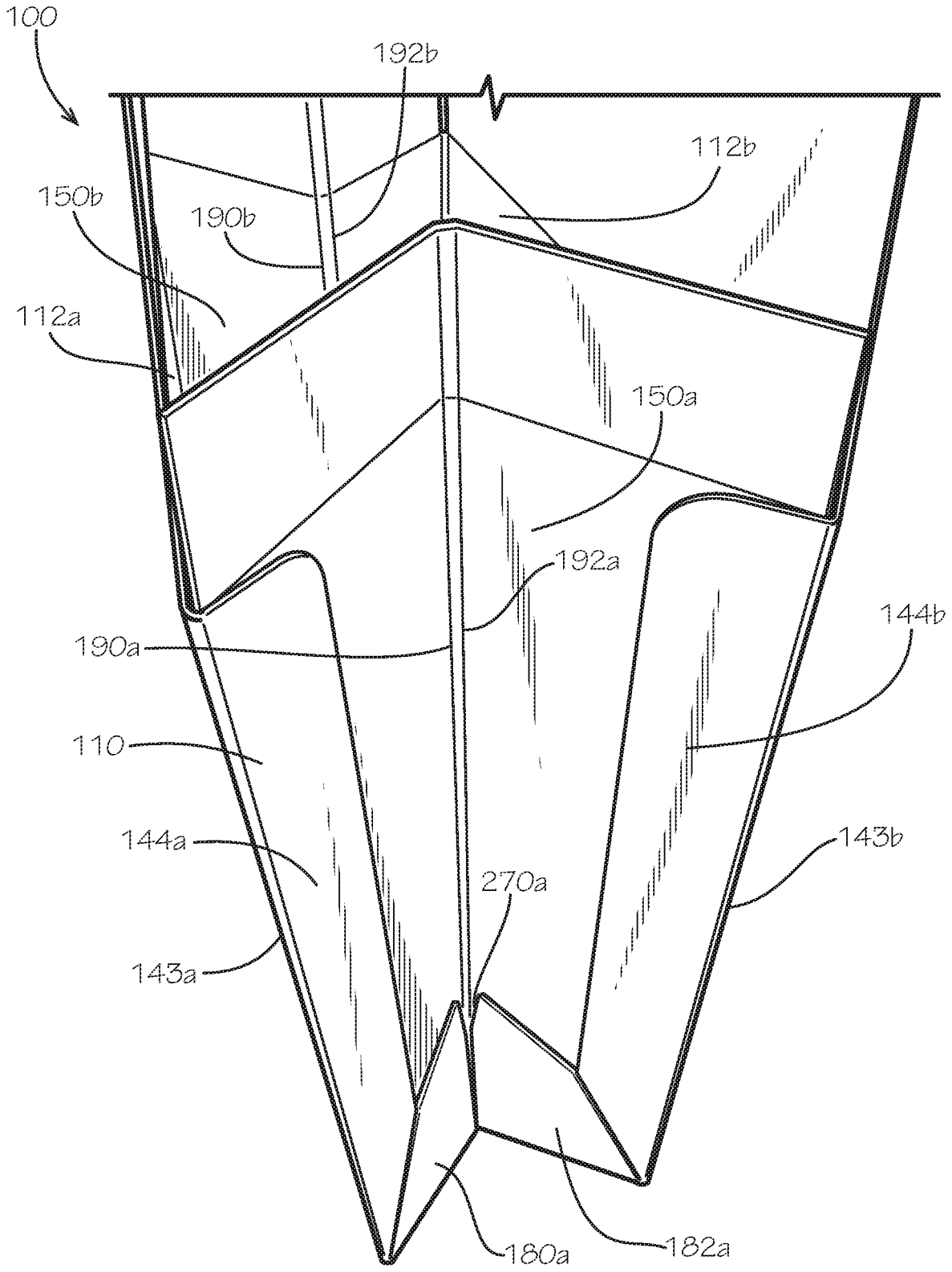
FIG. 4 is a perspective side view facing the first end panel of the reinforced box of FIG. 1 in a partially collapsed configuration.

FIG. 4 is a perspective side view facing the first end panel 150*a* of the reinforced box 100 showing the reinforced box 100 in a partially collapsed configuration. As shown, the first end panel 150*a* can fold about the end fold lines 190*a*,192*a*, and the side flaps 144*a,b* can fold about the first side flap hinges 143*a,b*, respectively to bring the side panels 112*a,b* towards one another. By incorporating two end fold lines 190*a*,192*a*, the first end panel 150*a* can more easily fold completely or nearly in half because the angular deflection is spread between the two end fold lines 190*a*,192*a*, thereby reducing strain on each end fold line 190*a*,192*a* by a factor of two. For example and without limitation, in an aspect of the first end panel 150*a* defining a single end fold line, the single end fold line can be deflected approximately 180° when folding the first end panel 150*a* completely in half. In the present aspect, each of the end fold lines 190*a*,192*a* can be deflected approximately 90° when folding the first end panel 150*a* completely in half, thereby decreasing strain on each end fold line 190*a*,192*a* and decreasing resistance when collapsing the reinforced box 100. In other aspects, however, the first end panel 150*a* may only define a single end fold line. In the aspect shown in FIG. 4, the side flaps 144*a,b* can optionally be untapered side flaps 144*a,b* with the major edges 242*a-d* being substantially parallel to one another and the respective sides 140*a,b*,142*a,b* of the side panels 112*a,b*.

FIG. 5 is a perspective view of the reinforced box 100 in the collapsed configuration. The reinforced box 100 can be further compressed by wrapping a band or strap around one or more reinforced boxes 100, such as for storage or shipping of the reinforced boxes. For example, in some aspects, the reinforced box 100 can be compressed until the first side flap 144*a* contacts the second side flap 144*b* (shown in FIG. 1), and the second side flap 144*c* (shown in FIG. 2) contacts the second side flap 144*d* (shown in FIG. 2). In the collapsed configuration, the end panels 150*a,b* can be folded, as shown by the first end panel 150*a*. The bottom panel 310 can be collapsed into the shape of a truncated rectangular pyramid. Pressing upon the center subpanel 320 (shown in FIG. 3) of the bottom panel 310 in the collapsed configuration, such as by pushing the reinforced box 100 against the ground, can force the reinforced box 100 to expand to the open configuration.

The side panels 112*a,b* can respectively define bottom ends 512*a,b* (512*b* shown in FIG. 6) which can be attached to the respective bottom side 312*a,b* by the respective side hinge 314*a,b*, as shown and described with respect to FIG. 6. FIG. 6 is a top view of the body board 110 of the reinforced box 100 of FIG. 1. The first end flaps 180*a,b* can be attached to the respective bottom ends 350*a,b* of the bottom panel 310 by the first end flap hinges 380*a,b*. The first end flap hinges 380*a,b* can extend along the respective bottom ends 350*a,b* between the first bottom side 312*a* and the respective first end fold lines 390*a,b*. The second end flaps 182*a,b* can be attached to the respective bottom ends 350*a,b* of the bottom panel 310 by the second end flap hinges 382*a,b*. The second end flap hinges 382*a,b* can extend along the respective bottom ends 350*a,b* between the second bottom side 312*b* and the respective second end fold lines 392*a,b*.

The first side hinge 314*a* can hingedly attach the bottom end 512*a* of the first side panel 112*a* to the first bottom side 312*a* of the bottom panel 310. The first top flap hinge 118*a* can hingedly attach the top end 116*a* of the first side panel 112*a* to a bottom end 616*a* of the first top flap 114*a*. The first top flap end 170*a* can be defined opposite from the bottom end 616*a* and the first top flap hinge 118*a*. The first top flap end 170*a* can define a first top portion 660*a* and a second top portion 662*a*, and the first top notch 172*a* can be disposed between the first top portion 660*a* and the second top portion 662*a*. The first top flap 114*a* can define a first side 690*a* proximate to the second side 142*a* of the first side panel 112*a* and a second side 692*a* proximate to the first side 140*a* of the first side panel 112*a*.

The first top portion 660*a* can define a first straight edge 670*a*, and the second top portion 662*a* can define a second straight edge 672*a*. In the present aspect, the first straight edge 670*a* can extend from the first top notch 172*a* to the first side 690*a*, and the second straight edge 672*a* can extend from the first top notch 172*a* to the second side 692*a*. In other aspects, one or both of the straight edges 670*a*,672*a* may not extend to the adjacent side 690*a*,692*a*.

The first top notch 172*a* can extend inwards from the first straight edge 670*a* and the second straight edge 672*a* and towards the first top flap hinge 118*a*. The first straight edge 670*a* and the second straight edge 672*a* can be substantially parallel to the first top flap hinge 118*a*. In the present aspect, a distance $D_1$ defined between the first straight edge 670*a* and the first top flap hinge 118*a* can be greater than a distance $D_2$ defined between the second straight edge 672*a* and the first top flap hinge 118*a*. In other aspects, the distance $D_2$ can be greater than or equal to the distance $D_1$. In other aspects, either or both of the straight edges 670*a*, 672*a* can be angled relative to the first top flap hinge 118*a*.

A first slit 682*a* can extend inwards from the second straight edge 672*a* of the first top flap end 170*a* and towards the first top flap hinge 118*a*. The first slit 682*a* can be defined between the first top notch 172*a* and the second side 692*a*. A first sealing tab 684*a* can be defined between the first slit 682*a* and the second side 692*a*, and the first sealing tab 684*a* can be hingedly attached to the first top flap 114*a* by a first tab hinge 680*a*. The first tab hinge 680*a* can extend between the first slit 682*a* and the second side 692*a*.

The second side hinge 314*b* can hingedly attach the bottom end 512*b* of the second side panel 112*b* to the second bottom side 312*b* of the bottom panel 310. The second top flap hinge 118*b* can hingedly attach the top end 116*b* of the second side panel 112*b* to a bottom end 616*b* of the second top flap 114*b*. The second top flap end 170*b* can be defined opposite from the bottom end 616*b* and the second top flap hinge 118*b*. The second top flap end 170*b* can define a first top portion 660*b* and a second top portion 662*b*, and the second top notch 172*b* can be disposed between the first top portion 660*b* and the second top portion 662*b*. The second top flap 114*b* can define a first side 690*b* proximate to the first side 140*b* of the second side panel 112*b* and a second side 692*b* proximate to the second side 142*b* of the second side panel 112*b*.

The first top portion 660*b* can define a first straight edge 670*b*, and the second top portion 662*b* can define a second straight edge 672*b*. In the present aspect, the first straight edge 670*b* can extend from the second top notch 172*b* to the first side 690*b*, and the second straight edge 672*b* can extend from the second top notch 172*b* to the second side 692*b*. In other aspects, one or both of the straight edges 670*b*,672*b* may not extend to the adjacent side 690*b*,692*b*.

The second top notch 172*b* can extend inwards from the first straight edge 670*b* and the second straight edge 672*b* and towards the second top flap hinge 118*b*. The first straight edge 670*b* and the second straight edge 672*b* can be substantially parallel to the second top flap hinge 118*b*. In the present aspect, a distance $D_3$ defined between the first straight edge 670*b* and the second top flap hinge 118*b* can be greater than a distance $D_4$ defined between the second straight edge 672*b* and the second top flap hinge 118*b*. In other aspects, the distance $D_4$ can be greater than or equal to the distance $D_3$. In the present aspect, the distance $D_3$ can be equal to the distance $D_1$, and the distance $D_4$ can be equal to the distance $D_2$. In other aspects, either or both of the straight edges 670*b*,672*b* can be angled relative to the second top flap hinge 118*b*.

A second slit 682*b* can extend inwards from the second straight edge 672*b* of the second top flap end 170*b* and towards the second top flap hinge 118*b*. The second slit 682*b* can be defined between the second top notch 172*b* and the second side 692*b*. A second sealing tab 684*b* can be defined between the second slit 682*b* and the second side 692*b*, and the second sealing tab 684*b* can be hingedly attached to the second top flap 114*b* by a second tab hinge 680*b*. The second tab hinge 680*b* can extend between the second slit 682*b* and the second side 692*b*.

In the present aspect, the major edges 242*a-d* of the side flaps 144*a-d* can taper towards the respective top ends 116*a,b* of the side panel 112*a,b*. In other aspects, the major edges 242*a-d* may not taper, and in some aspects, the major edges 242*a-d* can be substantially parallel to one another and the respective sides 140*a,b*,142*a,b* of the side panels 112*a,b* as shown and described above with respect to FIG. 4. In the present aspect, the minor edges 244*a-d* of the respective side panels 112*a,b* can taper downwards towards the bottom end 512*a,b* to form V-shaped notches with outer edges 246*a-d*, respectively.

Figure 7:
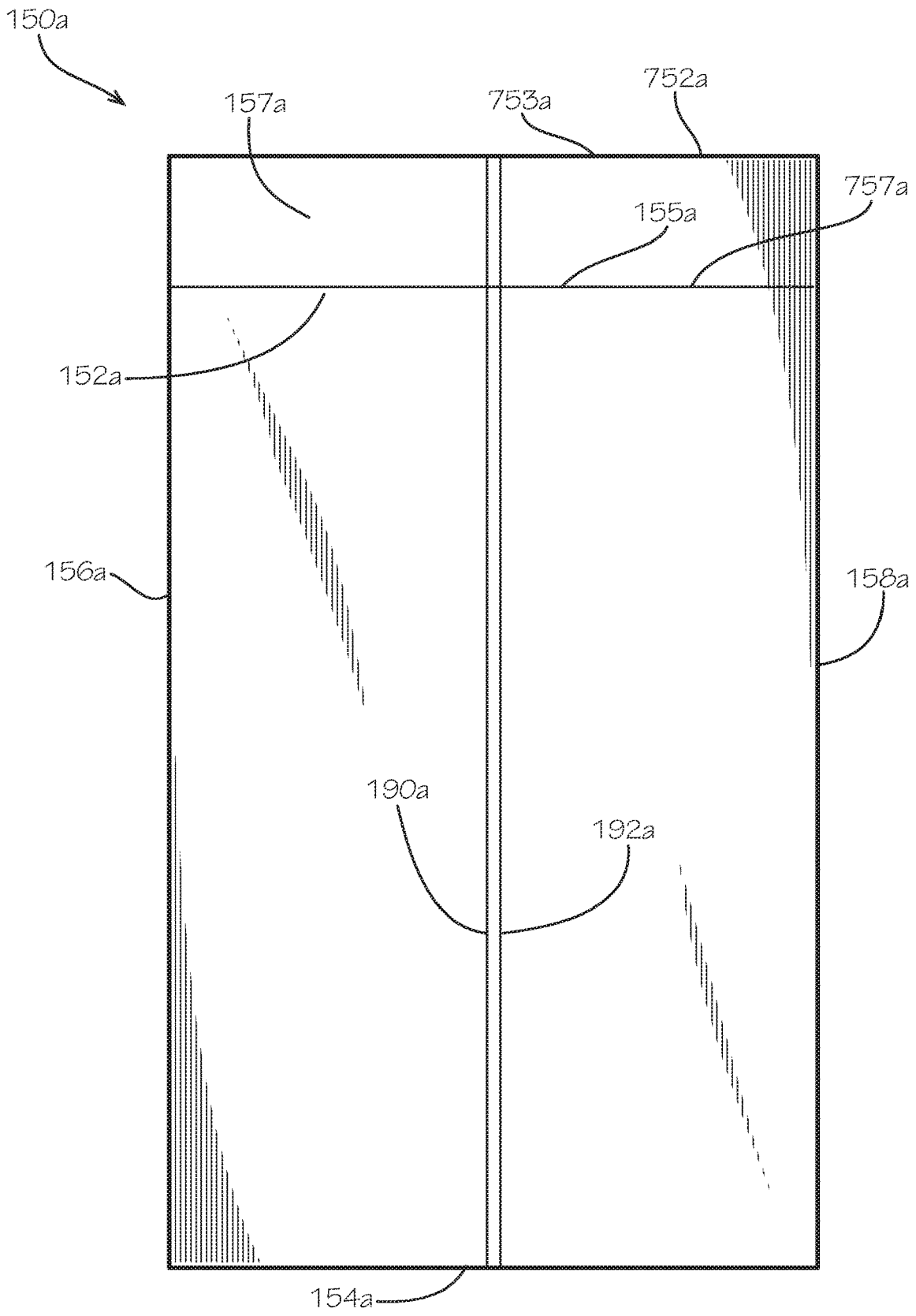
FIG. 7 is a top view of the first end panel of the reinforced box of FIG. 1.

FIG. 7 is a top view of the first end panel 150*a* of the reinforced box 100 of FIG. 1; however, the first end panel 150*a* can also be representative of the second end panel 150*b* in the present aspect. A bottom end 757*a* of the first top end flap 157*a* can be hingedly attached to the top end 152*a* of the first end panel 150*a* by the first top flap hinge 155*a*. The first top end flap 157*a* can define a top end 752*a* disposed opposite from the bottom end 757*a*. The end fold lines 190*a*,192*a* can extend across the first top end flap 157*a* from the top end 752*a* to bottom end 154*a* of the end panel 150*a*. In the present aspect, the top end 752*a* can define a straight edge 753*a* extending across the top end 752*a*; however in other aspects, the top end 752*a* can define a notch (not shown), similar to the top notches 172*a,b* (shown in FIG. 1), and the notch can be configured to interlock with a notch defined by the second top end flap 157*b* (shown in FIG. 1). However, in the present aspect, the top end flaps 157*a,b* are not configured to contact one another in the closed configuration. In addition, in the current aspect, the end fold lines 190*a*,192*a* can extend through the top end flap 157*a* from the top flap hinge 155*a* to the straight edge 753*a*.

Figure 8:
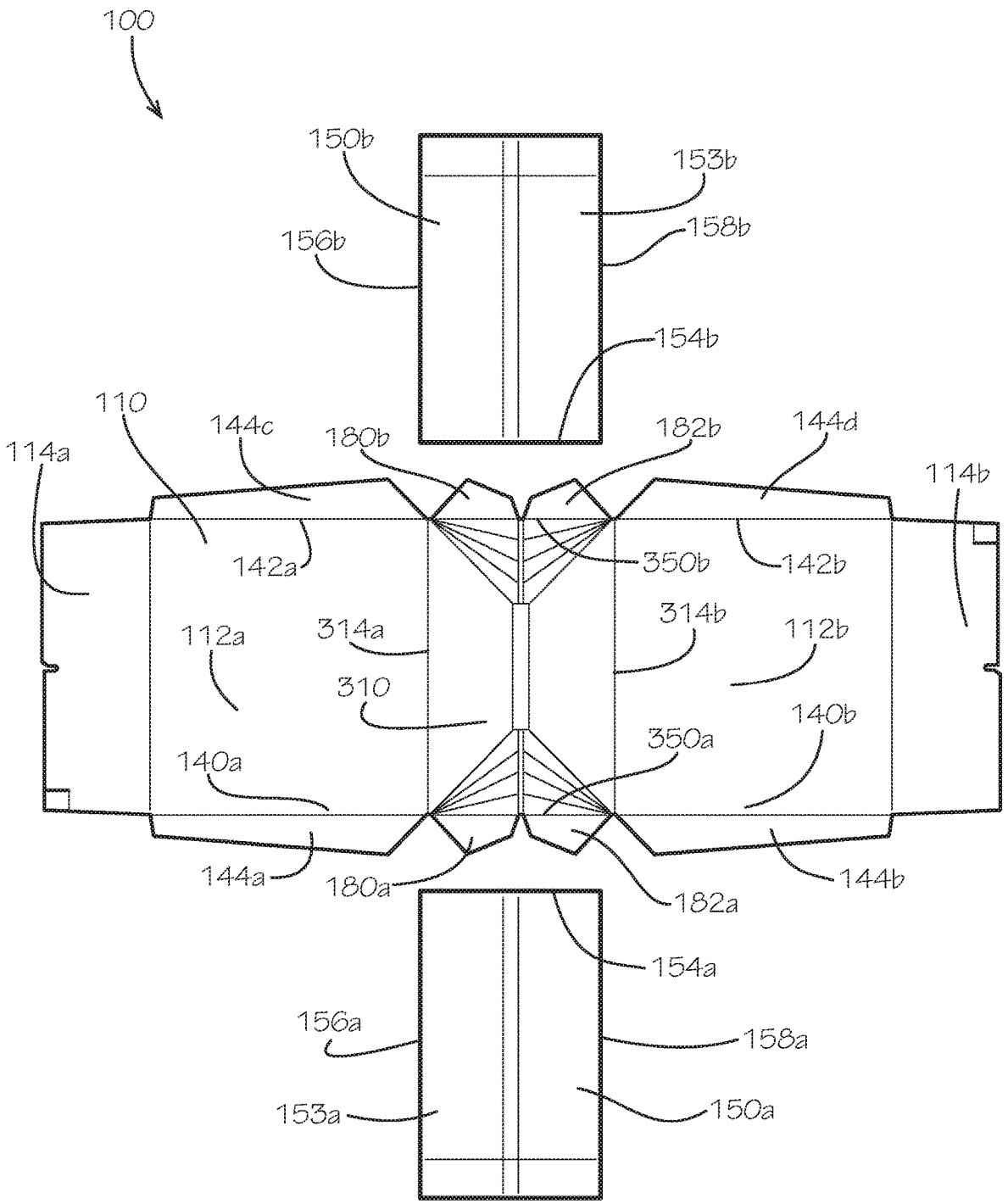
FIG. 8 is a top view of the reinforced box of FIG. 1 in a disassembled state.
Figure 9:
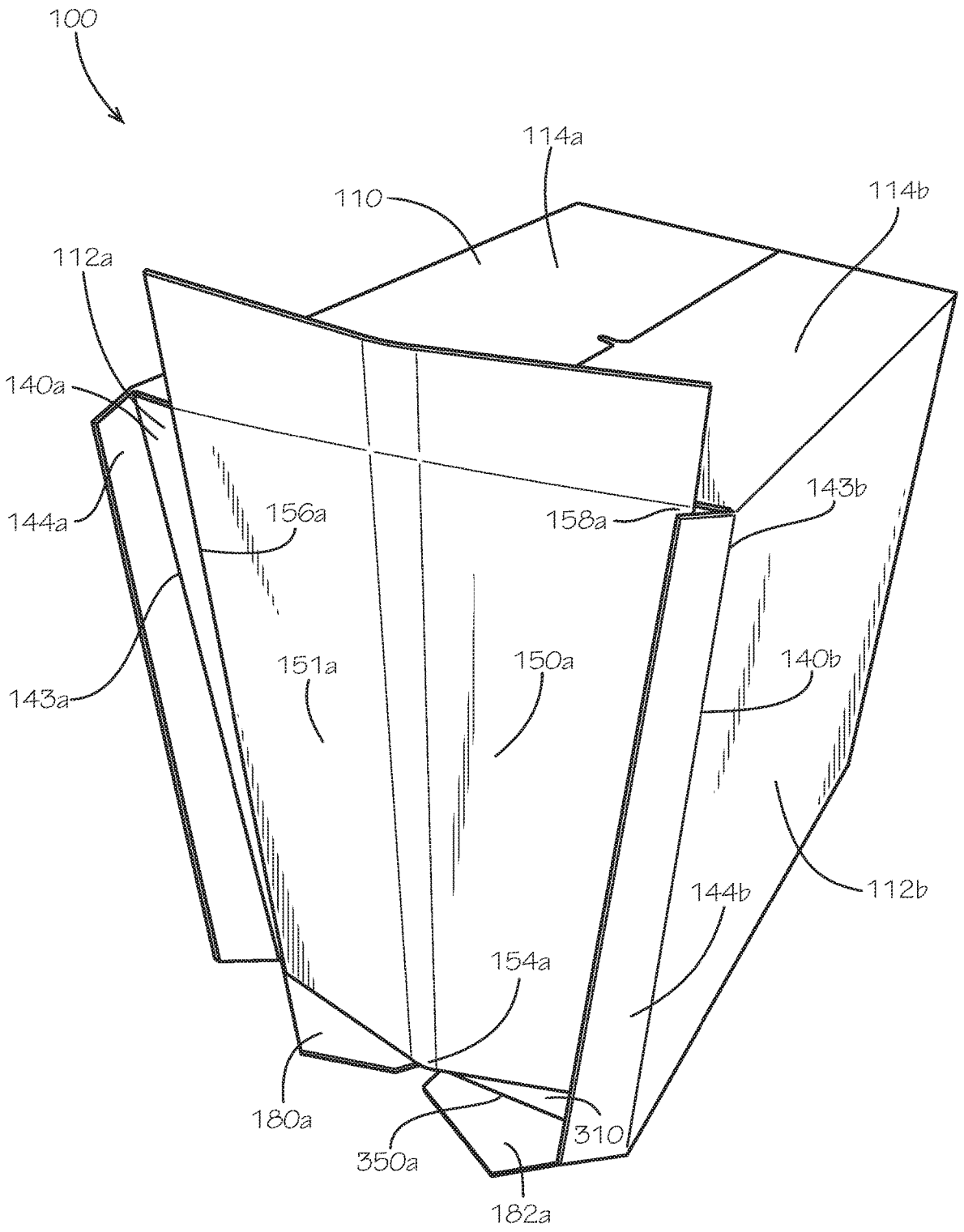
FIG. 9 is a perspective view of the reinforced box of FIG. 1 in a partially assembled state.

FIG. 8 is a top view of the reinforced box 100 in a disassembled state. The bottom end 154*a* of the first end panel 150*a* can be positioned near the first bottom end 350*a* of the bottom panel 310, and the bottom end 154*b* of the second end panel 150*b* can be positioned near the first bottom end 350*b* of the bottom end panel. The bottom ends 154*a,b* of the end panels 150*a,b* can be aligned with the respective bottom ends 350*a,b*, and the side panels 112*a,b* can be folded about the side hinges 314*a,b* to align the sides 156*a,b*,158*a,b* of the respective end panels 150*a,b* with the sides 140*a,b*,142*a,b* of the respective side panels 112*a,b*, as shown by the first end panel 150*a* in FIG. 9. FIG. 9 is a perspective view of the reinforced box 100 in a partially assembled state. The end flaps 180*a,b*,182*a,b* (end flaps 180*b*,182*b* shown in FIG. 8) and the side flaps 144*a-d* (side flaps 144*c,d* shown in FIG. 8) can be folded and attached to the outer surface 151*a,b* (outer surface 151*b* shown in FIG. 2) of the respective end panels 150*a,b* (second end panel 150*b* shown in FIG. 8) to complete assembly of the reinforced box 100.

Figure 10:
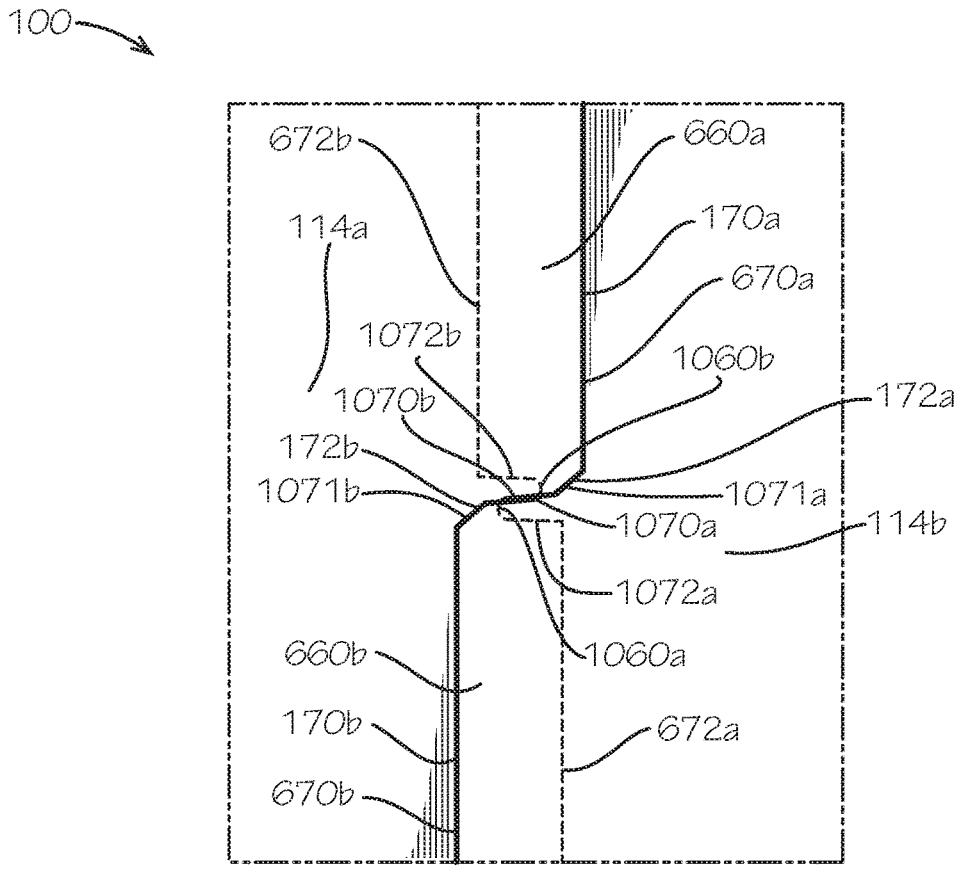
FIG. 10 is a top detail view of the reinforced box of FIG. 1 in a closed configuration showing a first top notch of the reinforced box interlocking with a second top notch of the reinforced box.

FIG. 10 is a top detail view of the reinforced box 100 in the closed configuration showing the first top notch 172*a* interlocking with the second top notch 172*b*. With the top notches 172*a,b* interlocking, the first top portion 660*a* of the first top flap end 170*a* can overlie the second top portion 662*b* (shown in FIG. 6) of the second top flap end 170*b*, as shown by the underlying second straight edge 672*b* defined by the second top portion 662*b*. Similarly, the first top portion 660*b* of the second top flap end 170*b* can overlie the second top portion 662*a* (shown in FIG. 6) of the first top flap end 170*a*, as shown by the underlying second straight edge 672*a* defined by the second top portion 662*a*. The top flap ends 170*a,b* of the opposing top flaps 114*a,b* can interweave when the top notches 172*a,b* of the opposing top flaps 114*a,b* are interlocked. By interlocking the top notches 172*a,b* and interweaving the top flap ends 170*a,b* of the respective top flaps 114*a,b*, the top flaps 114*a,b* can be secured together to maintain the reinforced box 100 in the closed configuration.

Each of the top notches 172*a,b* can define a notch bottom 1060*a,b*, respectively. In the present aspect, the notch bottoms 1060*a,b* can be curved, such as a semi-circular arc, for example and without limitation. In other aspects, the notch bottoms 1060*a,b* can be a different shape such as triangular, square, or any other suitable shape. Each top notch 172*a,b* can define a first notch side 1070*a,b* extending between the notch bottom 1060*a,b* and the respective first straight edge 670*a,b* and a second notch side 1072*a,b* extending between the notch bottom 1060*a,b* and the respective second straight edge 672*a,b*.

In the present aspect, intersections between the first notch sides 1070*a,b* and the respective first straight edges 670*a,b* can define chamfered corners 1071*a,b*. In other aspects, the intersections between the first notch sides 1070*a,b* and the respective straight edges 670*a,b* can define a different shape, such as a rounded corner, a square corner, or any other suitable shape. Further, in the present aspect, the second notch sides 1072*a,b* can directly intersect the respective straight edges 672*a,b* at a right angle to define a square corner. In other aspects, intersections between the second notch sides 1072*a,b* and the respective second straight edges 672*a,b* can define chamfered corners, rounded corners, or any other suitable corner shape in place of the square corners shown.

The chamfered corners 1071*a,b* can guide the top notches 172*a,b* to interlock with one another. In the present aspect, the top notches 172*a,b* can be offset so that the first notch sides 1070*a,b* can substantially align and frictionally engage one another when the top notches 172*a,b* are interlocked. As shown, the notch bottoms 1060*a,b* can be offset such that the first notch sides 1070*a,b* align with one another rather than the first notch sides 1070*a,b* aligning with the second notch sides 1072*a,b* of the opposite top notch 172*a,b*. Frictional engagement between the first notch sides 1070*a,b* can resist accidental disengagement between the interlocked top notches 172*a,b*.

Figure 11:
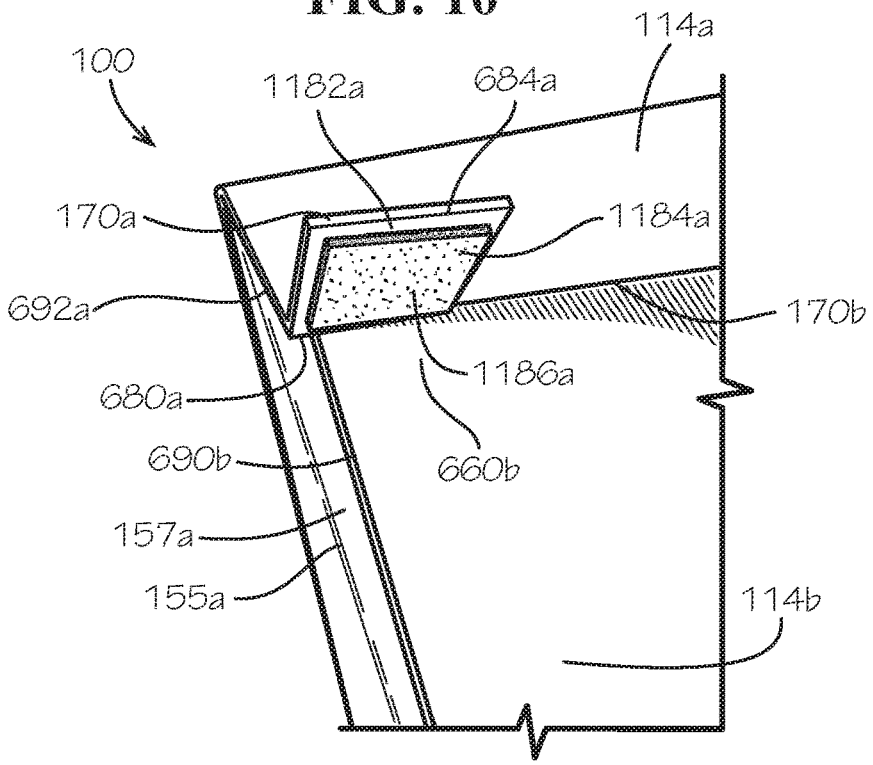
FIG. 11 is a detailed perspective view of a first sealing tab of a first top flap of the reinforced box of FIG. 1.

FIG. 11 is a detailed perspective view of the first sealing tab 684*a* of the first top flap 114*a*. The first sealing tab 684*a* can be representative of the second sealing tab 684*b* (shown in FIG. 6) in the present aspect. The first sealing tab 684*a* can comprise an double-sided adhesive pad 1184*a* which can be attached to an underside 1182*a* of the first sealing tab 684*a* which can face the first top portion 660*b* of the second top flap end 170*b* when the reinforced box 100 is in the closed configuration. In the present aspect, the double-sided adhesive pad 1184*a* can comprise a backing 1186*a* which can cover and protect an adhesive (not shown) of the double-sided adhesive pad 1184*a*. The backing 1186*a* can be removed to expose the adhesive and attach the double-sided adhesive pad 1184*a* to the first top portion 660*b* of the second top flap end 170*b*. With the double-sided adhesive pad 1184*a* securing the first sealing tab 684*a* to the second top flap end 170*b*, the top flaps 114*a,b* can be secured together in the closed configuration. In other aspects, an adhesive applied directly to the underside 1182*a* can attached the first sealing tab 684*a* to the second top flap end 170*b*. In other aspects, another adhesive product such as a double-sided tape, cohesive, glue, mastic, cement, or any other adhesive product can attach the first sealing tab 684*a* to the second top flap end 170*b*. In some aspects, the first sealing tab 684*a* can be mechanically attached to the second top flap end 170*b* such as with interlocking notches, hook-and-loop fasteners, staples, or any other suitable attachment mechanism.

FIG. 12 is a perspective top view of the reinforced box 100 of FIG. 1 in the closed configuration and further comprising an adhesive seal 1210. In the closed configuration, the top flap ends 170*a,b* of the respective top flaps 114*a,b* can be interwoven. The first top portion 660*a* of the first top end 170*a* can overlie the second top portion 662*b* (shown in FIG. 6) of the second top flap end 170*b*, as shown by the underlying second straight edge 672*b* which can be defined by the second top portion 662*b*. However, the second sealing tab 684*b* can overlie and attach to a portion of the first top portion 660*a* proximate to the second end panel 150*b* (shown in FIG. 2). Similarly, the first top portion 660*b* of the second top flap end 170*b* can overlie the second top portion 662*a* (shown in FIG. 6) of the first top flap end 170*a*, as shown by the underlying second straight edge 672*a*. However, the first sealing tab 684*a* can overlie and attach to a portion of the first top portion 660*b* proximate to the first end panel 150*a*.

Figure 13:
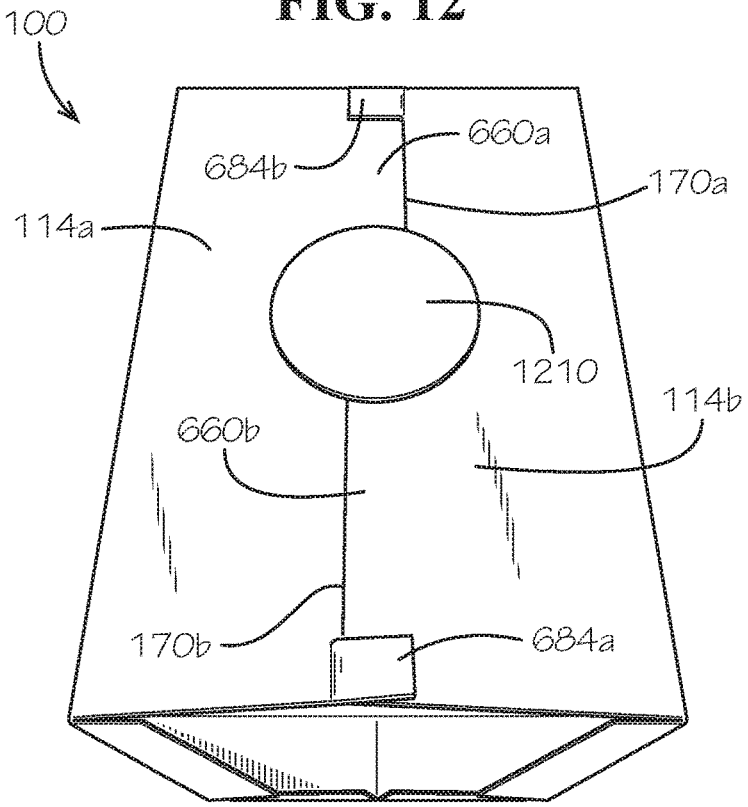
FIG. 13 is a perspective top view of the reinforced box of FIG. 1 in the closed configuration with the adhesive seal attached to the reinforced box.

With the respective sealing tabs 684*a,b*, first top portions 660*a,b*, and second top portions 662*a,b* interwoven, the reinforced box 100 can be sealed in the closed configuration. In the present aspect, the adhesive seal 1210 can also seal the reinforced box 100 in the closed configuration. The adhesive seal 1210 can be placed over the interlocking top notches 172*a,b*, as shown in FIG. 13, thereby attaching to at least the first top portion 660*a,b* of each respective top flap 114*a,b* and preventing disengagement between the interlocking top notches 172*a,b*. In some aspects, the adhesive seal 1210 can define indicia (not shown) which can indicate a quality seal, a brand logo, information about the contents of the reinforced box 100, handling instructions, or any other useful or desirable information.

In the present aspect, the body board 110 and the end panels 150*a,b* of the reinforced box 100 can comprise a rigid board material, such as corrugated cardboard, posterboard, or any other suitable material. Fold lines and hinges defined by the body board 110 and the end panels 150*a,b* can be living hinges which can be formed by scoring or creasing the body board 110 and the end panels 150*a,b*, respectively. Because the body board 110 and the end panels 150*a,b* are separate components in the present aspect, the body board 110 and the end panels 150*a,b* can comprise different materials. For example, the end panels 150*a,b* can comprise a heavyweight cardboard material, and the body board 110 can comprise a lightweight cardboard material. By utilizing heavier and stronger material in the end panels 150*a,b*, the end panels 150*a,b* can reinforce the reinforced box 100 and increase a stacking strength of the reinforced box 100 which increases a downward force the reinforced box 100 can support without collapsing. By forming the body board 110 of lighter material, a weight of the reinforced box 100 and material costs of the reinforced box 100 can be reduced without sacrificing the stacking strength of the reinforced box 100.

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

It should be emphasized that the above-described embodiments are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A reinforced box comprising:

a body board comprising a first material, the body board comprising:

a bottom panel defining a first bottom side and a second bottom side, the first bottom side positioned opposite from the second bottom side;

a first side panel hingedly attached to the first bottom side of the bottom panel; and a second side panel hingedly attached to the second bottom side of the bottom panel; and an end panel comprising a second material, the second material being different from the first material, a first portion of the end panel attached to the first side panel, a second portion of the end panel attached to the second side panel, at least one end fold line defined between the first portion and the second portion; and wherein the reinforced box is selectively reconfigurable from a collapsed configuration to an open configuration, the first portion folded relative to the second portion about the at least one end fold line in the collapsed configuration, the first portion and the second portion of the end panel positioned perpendicular with the first side panel and the second side panel in the open configuration.

2. The reinforced box of claim 1, wherein:

the first material defines a first thickness;

the second material defines a second thickness; and the second thickness is larger than the first thickness.

3. The reinforced box of claim 1, wherein:

the first material is lightweight cardboard; and the second material is heavyweight cardboard.

4. The reinforced box of claim 1, wherein:

the end panel is a first end panel;

the reinforced box comprises a second end panel positioned opposite from the first end panel;

the second end panel comprises the second material; and the second end panel is attached to the first side panel and the second side panel.

5. The reinforced box of claim 1, wherein:

the first side panel comprises a side flap; and the side flap is attached to the end panel.

6. The reinforced box of claim 5, wherein the side flap is attached to the end panel with an adhesive.

7. The reinforced box of claim 1, wherein:

the body board further comprises an end flap hingedly attached to an end of the bottom panel;

the end extends between the first bottom side and the second bottom side; and the end flap is attached to the end panel.

8. The reinforced box of claim 7, wherein:

the end flap is a first end flap;

the body board further comprises a second end flap hingedly attached to the end of the bottom panel;

the second end flap is attached to the end panel;

an end flap notch is defined between the first end flap and the second end flap; and the end flap notch is configured to provide clearance for the bottom panel to collapse.

9. A method of assembling a reinforced box, the method comprising:

folding a first side panel about a first side hinge relative to a bottom panel;

folding a second side panel about a second side hinge relative to the bottom panel, the first side panel, the second side panel, and the bottom panel comprised by a body board of the reinforced box, the body board comprising a first material;

attaching a first portion of a first end panel to the first side panel and a second portion of the first end panel to the second side panel, at least one end fold line defined between the first portion and the second portion, the first end panel comprising a second material, the second material being different from the first material;

attaching a second end panel to the first side panel and the second side panel, the second end panel comprising the second material; and collapsing the reinforced box from an open configuration to a collapsed configuration comprising folding the first portion relative to the second portion about the at least one end fold line.

10. The method of claim 9, wherein:

the first material defines a first thickness;

the second material defines a second thickness; and the second thickness is larger than the first thickness.

11. The method of claim 9, wherein:

the first side panel comprises a first side flap and a second side flap;

attaching the first end panel to the first side panel comprises attaching the first side flap to the first end panel; and attaching the second end panel to the first side panel comprises attaching the second side flap to the first end panel.

12. The method of claim 11, wherein attaching the first side flap to the first end panel comprises adhering the first side flap to the first end panel.

13. The method of claim 11, wherein the first side flap and the second side flap are hingedly connected to the first side panel.

14. The method of claim 9, further comprising attaching an end flap of the body board to the first end panel, the end flap hingedly attached to the bottom panel.

15. The method of claim 14, wherein the end flap is a first end flap, and wherein the method further comprises attaching a second end flap of the body board to the first end panel, the second end flap hingedly attached to the bottom panel.

16. The method of claim 15, wherein an end flap notch is defined between the first end flap and the second end flap; and wherein the end flap notch provides clearance for the bottom panel to collapse.

17. The method of claim 9, wherein:

the body board further comprises a first top flap hingedly attached to the first side panel by a first top flap hinge and a second top flap hingedly attached to the second side panel by a second top flap hinge; and the method further comprises:

folding the first top flap about the first top flap hinge;

folding the second top flap about the second top flap hinge; and engaging the first top flap with the second top flap.

18. The method of claim 17, wherein engaging the first top flap with the second top flap comprises interlocking a first top notch with a second top notch, the first top notch defined by a first top flap end of the first top flap, the second top notch defined by a second top flap end of the second top flap.

* * * * *